US008757329B2

(12) United States Patent
Taiana

(10) Patent No.: US 8,757,329 B2
(45) Date of Patent: Jun. 24, 2014

(54) ELEVATOR CALL INPUT DEVICES

(75) Inventor: Dennys Taiana, Losone (CH)

(73) Assignee: Inventio AG, Hergiswil NW (CH)

( * ) Notice: Subject to any disclaimer, the term of this patent is extended or adjusted under 35 U.S.C. 154(b) by 628 days.

(21) Appl. No.: 13/119,847

(22) PCT Filed: Sep. 10, 2009

(86) PCT No.: PCT/EP2009/061722

§ 371 (c)(1),
(2), (4) Date: May 20, 2011

(87) PCT Pub. No.: WO2010/031724

PCT Pub. Date: Mar. 25, 2010

(65) Prior Publication Data

US 2012/0097488 A1 Apr. 26, 2012

Related U.S. Application Data

(60) Provisional application No. 61/098,309, filed on Sep. 19, 2008.

(30) Foreign Application Priority Data

Sep. 19, 2008 (EP) ..... 08164720

(51) Int. Cl.
*B66B 1/34* (2006.01)

(52) U.S. Cl.
USPC ..... 187/395; 187/391; 187/901

(58) Field of Classification Search
USPC ..... 187/247, 391–396, 399, 901; 345/156, 345/158, 13, 175, 176, 184
See application file for complete search history.

(56) References Cited

U.S. PATENT DOCUMENTS

| | | | | |
|---|---|---|---|---|
| 6,152,265 | A * | 11/2000 | Bittar et al. | 187/384 |
| 6,636,203 | B1 * | 10/2003 | Wong et al. | 345/173 |
| 6,828,918 | B2 * | 12/2004 | Bowman et al. | 340/4.1 |
| 6,902,041 | B2 * | 6/2005 | Eccleston | 187/380 |
| 7,184,032 | B2 * | 2/2007 | Stohrer et al. | 345/173 |
| 7,207,422 | B2 * | 4/2007 | Takeuchi | 187/391 |
| 7,277,081 | B2 * | 10/2007 | Ukita et al. | 345/156 |
| 7,496,445 | B2 * | 2/2009 | Mohsini et al. | 701/434 |
| 8,243,025 | B2 * | 8/2012 | Fibaek | 345/170 |
| 8,368,662 | B2 * | 2/2013 | Argiro | 345/173 |
| 2005/0252725 | A1 | 11/2005 | Felder et al. | |
| 2006/0007179 | A1 * | 1/2006 | Pihlaja | 345/173 |
| 2008/0238879 | A1 * | 10/2008 | Jaeger et al. | 345/173 |
| 2013/0100040 | A1 * | 4/2013 | Haynes et al. | 345/173 |

FOREIGN PATENT DOCUMENTS

| | | | |
|---|---|---|---|
| EP | 1864933 | | 12/2007 |
| WO | WO 2007046807 | A1 * | 4/2007 |

* cited by examiner

*Primary Examiner* — Anthony Salata
(74) *Attorney, Agent, or Firm* — Stroock & Stroock & Lavan LLP

(57) ABSTRACT

A call input device includes at least one touch screen for entering at least one call for an elevator installation. At least one switch protrudes from at least one area of the call input device outside of the touch screen in at least one first input area of the touch screen.

18 Claims, 4 Drawing Sheets

| Element | Name | Element | Name |
|---|---|---|---|
| 1, 1' | Call input device | 9, 9' | Door drive |
| 2, 2' | Bus system | 10, 10' | Elevator drive |
| 4 | Destination call controller | 11, 11' | Floor door |
| 5, 5' | Elevator controller | 12, 12' | Car door |
| 6, 6' | Car | 14, 14' | Signal line |
| 7, 7' | Counterweight | S1, S2, S3 | Floor |
| 8, 8' | Support | S4, S4' | Shaft |
| 100 | Programming station | | |

ELEVATOR CALL INPUT DEVICES

FIELD

The disclosure relates to elevator call input devices.

BACKGROUND

It is known that an elevator having an elevator car transports passengers between floors in a building. For this purpose, the passengers enter floor calls or car calls on input devices which are arranged on the floors and in elevator cars. Within the process of ensuring equality for passengers with disabilities, European Standard 81-70 for this purpose specifies a pushbutton for the disabled. The elevator is changed to a specific operating mode by pushing the pushbutton for the disabled. In this operating mode, elevator doors are opened and closed more slowly on the floors and on the elevator cars, and passengers with disabilities receive feedback from the call input via visible and/or audible signals.

EP1598298A1 discloses an elevator having a car call input device in an elevator car. The car call input device has a touchscreen which does not comply with EN81-70 since it does not have a pushbutton for the disabled.

As a solution which complies with EN81-70, EP1598298A1 teaches the fitting of a pushbutton for the disabled on the touchscreen. An upper face of the pushbutton for the disabled can be identified clearly by the blind by Braille script characters with a relief height of at least 0.8 mm. An area of the touchscreen below the pushbutton for the disabled is operated, and a car call is produced, by pushing the pushbutton for the disabled with a pressure force of 2.5N to 5.0N.

SUMMARY

At least some embodiments of the disclosed technologies relate to a call input device having at least one touchscreen for inputting at least one call for an elevator installation. At least one switch projects from at least one area of the call input device, outside the touchscreen, into at least one first input area on the touchscreen.

This can mean that a passenger with a disability can enter a call in compliance with EN81-70 on a call input device having a touchscreen, and is thus transported in the building by the elevator installation without necessarily being disadvantaged by the disability. The passenger with a disability can thus take part in business life, can make social contacts, can carry out training and development, and can carry out a working activity more easily.

The switch can have a diameter of 10 mm to 20 mm. The switch can have a thickness of 2 mm to 10 mm.

This can mean that the switch is physically small and flat.

The switch can be composed of plastic material such as polyurethane, polypropylene, polyethylene etc., or metal material such as aluminum, sheet steel etc., or alloy material such as brass, bronze etc.

This can mean that the switch is composed of proven materials.

The switch can be attached in a force-fitting, interlocking and/or integral manner to the call input device. The switch can be attached in an interlocking and force-fitting manner to at least one edge of a housing of the call input device. The switch can be inserted into at least one groove in the call input device and can thus be attached in an interlocking and force-fitting manner.

This can mean that the switch can be attached to the call input device easily and quickly.

The switch can sometimes be removed non-destructively from the call input device again when reversibly attached to the call input device. The switch can sometimes be removed from the call input device again only by at least partial destruction when irreversibly attached to the call input device.

This can mean that the switch can be attached reversibly or irreversibly to the call input device, if desired.

In some embodiments, a front face of the switch can be seen by a passenger and can be touched directly by the passenger. In some cases, the front face of the switch has a wheelchair user pictogram. In further cases, the front face of the switch has Braille script characters which are at least 0.8 mm high. Sometimes, the switch can be moved from a first, non-switching position, to a second, switching position in the first input area on the touchscreen. In further embodiments, the switch can be moved from a first, non-switching position, to a second, switching position by a pressure force of 2.5N to 5.0N. Possibly, the switch can be moved from a first, non-switching position, to a second, switching position, and produces at least one acoustic feedback between 35 dB and 65 dB. Possibly, the switch produces at least one acoustic feedback between 35 dB and 65 dB during a movement from a second, switching position, to a first, non-switching position.

In some embodiments the switch is designed to comply with EN81-70.

In some cases, the switch is elastically prestressed and is automatically moved back from a second, switching position, to a first, non-switching position in the absence of a pressure force of 2.5N to 5.0N. Possibly, the switch is automatically moved back from a second, switching position, to a first, non-switching position within five seconds, preferably two seconds, in the absence of a pressure force of 2.5N to 5.0N.

This can mean that the switch automatically returns to the initial position again after switching.

In some cases, the switch does not touch the touchscreen in a first, non-switching position, and the switch touches at least one first functional designator on the touchscreen in a second, switching position.

This can mean that the switch switches a first functional designator, which is in principle freely programmable.

Some embodiments of the disclosed technologies relate to an elevator installation having a call input device which produces a first input signal when the first functional designator is touched. The call input device transmits the first input signal to at least one destination call controller or elevator controller. The destination call controller or the elevator controller changes the elevator installation to at least one specific operating mode for a received first input signal.

This can mean that a passenger with a disability changes the elevator installation to a specific operating mode by operating the switch, and that the passenger is thus transported in the building by the elevator installation without necessarily being disadvantaged by the disability.

In some cases, the touching of a further functional designator produces a further input signal. The call input device transmits the further input signal to the destination call controller or the elevator controller. The destination call controller or the elevator controller operates at least one call for a received further input signal.

This can mean that a passenger can produce a call for the elevator installation by touching a further functional designator.

In some cases, at least one identification device of the call input device identifies at least one identification code. The call input device or the destination call controller operates at least one destination call for a received identified identification code.

This can mean that a passenger can produce a destination call for the elevator installation without touching, by identification of an identification code.

The touching of the first functional designator sometimes changes the elevator installation to a specific operating mode for a predetermined time period of five seconds to twenty seconds. Possibly, the touching of the first functional designator and the touching of the further functional designator on a call input device change the elevator installation to a specific operating mode until the call which is made by the touching of the further functional designator has been carried out completely. The touching of the first functional designator and transmission of an identified identification code can change the elevator installation to a specific operating mode until a destination call which is made by the transmission of the identified identification code has been carried out completely.

This can mean that, once the elevator installation has been changed to the specific operating mode on a call input device, the passenger with a disability can produce a call or destination call which is handled by the elevator installation in the specific operating mode.

The first input signal in at least some cases indicates that a passenger can move or can be oriented in the building only using at least one disabled-specific aid. The first input signal sometimes indicates that a passenger can move or can be oriented in the building only using at least one disabled-specific aid, which disabled-specific aid is a wheelchair or a hospital bed on rollers, or a crutch, or a hearing aid, or a vision aid, or a blind person's stick, or a guide dog for the blind, or an accompanying passenger. Possibly, at least one identification device of the call input device identifies at least one identification code, and the call input device or the destination call controller reads at least one passenger information item for a received identified identification code, which read passenger information item indicates that a passenger can move or can be oriented in the building only using at least one disabled-specific aid. Possibly, at least one identification device of the call input device identifies at least one identification code, and the call input device or the destination call controller reads at least one passenger information item for a received identified identification code, which read passenger information item indicates that a passenger can move or can be oriented in the building only using at least one disabled-specific aid, which disabled-specific aid is a wheelchair or a hospital bed on rollers, or a crutch, or a hearing aid, or a vision aid, or a blind person's stick, or a guide dog for the blind, or an accompanying passenger.

This can mean that the passenger with a disability can indicate that he can move or can be oriented in the building only with a disabled-specific aid.

In some cases, the first input signal indicates that a passenger can move in the building only using at least one personal-protection-specific aid. Sometimes, the first input signal indicates that a passenger can move in the building only using at least one personal-protection-specific aid, which personal-protection-specific aid is a three-dimensional protection zone, a time protection zone or a personal protector. Sometimes, at least one identification device of the call input device identifies at least one identification code, and the call input device or the destination call controller reads at least one passenger information item for a received identified identification code, which read passenger information item indicates that a passenger can move in the building only using at least one personal-protection-specific aid. In some cases, at least one identification device of the call input device identifies at least one identification code, and the call input device or the destination call controller reads at least one passenger information item for a received identified identification code, which read passenger information item indicates that a passenger can move in the building only using at least one personal-protection-specific aid, which personal-protection-specific aid is a three-dimensional protection zone, a time protection zone or a personal protector.

This can mean that personal safety of the passenger against attacks by third parties can be ensured in the building even when conveying a passenger who needs protection, that is to say a passenger with a potential security risk using the elevator car.

Further embodiments relate to a method for operation of an elevator installation, wherein at least one elevator door is closed with a particularly long delay and/or particularly slowly for a passenger having at least one disabled-specific aid.

This can mean that a passenger with a disability has sufficient time to enter and leave the elevator car.

Further embodiments relate to a method for operation of an elevator installation, wherein at least one elevator car is stopped with particular accuracy at a floor for a passenger having at least one disabled-specific aid.

This can mean that the passenger with a disability can enter and leave the elevator car without any steps.

Further embodiments relate to a method for operation of an elevator installation, wherein a passenger having at least one disabled-specific aid and/or at least one personal-protection-specific aid is assigned a particularly large amount of space in at least one elevator car.

This can mean that the passenger with a disability has a large amount of space for his disabled-specific aid and/or personal-protection-specific aid.

Further embodiments relate to a method for operation of an elevator installation, wherein a passenger having at least one personal-protection-specific aid is transported by at least one elevator car from a call input floor directly to a destination floor.

This can mean that a passenger with a disability is conveyed directly and therefore quickly to the desired destination floor.

In some cases, at least one input signal and/or at least one read passenger information item is confirmed visually or audibly by at least one acknowledgement signal on the touchscreen and/or by at least one tone transmitter. In further cases, the acknowledgement signal confirms a call input by the passenger.

This can mean that the passenger receives feedback on the call input device in response to the production of an input signal or for passenger information that has been read.

In some cases, the acknowledgement signal confirms that the elevator installation has been changed to the specific operating mode. Possibly, the acknowledgement signal confirms that the elevator installation has been changed to the normal operating mode.

This can mean that the passenger with a disability is informed of the start and end of the specific operating mode.

In further embodiments, the acknowledgment signal is used to check whether the passenger has at least one disability.

This can mean that it is possible to distinguish between different disabilities of passengers with a disability, and in some cases to deliberately take account of contradictory elevator-installation-specific parameters.

In some cases, the acknowledgement signal is used to check for at least one communication language desired by the passenger.

This can mean that the passenger can state his preferred communication language.

In further cases, the acknowledgment signal provides at least one aid.

This can mean that the passenger receives interactive aid for using the call input device.

In further cases, the acknowledgement signal confirms at least one read passenger information item.

This can mean that the passenger receives feedback in response to a transmitted identification code.

In further embodiments, at least one direction of travel desired by the passenger is output with the acknowledgement signal. Possibly, a destination floor desired by the passenger is output with the acknowledgement signal. Possibly, at least one elevator shaft which is handling a call is identified by the acknowledgement signal. Possibly, at least one start and/or at least one duration of opening/closing of an elevator door is output with the acknowledgment signal. Possibly, at least one arrival time of an elevator car at a start floor and/or at a destination floor is output with the acknowledgment signal.

This can mean that the passenger receives a wide range of useful and helpful information from the call input device, which information makes it easier and pleasant to travel using the elevator installation.

In additional embodiments, one of a plurality of first functional designators is selected by the switch depending on the time duration of touching the first input area on the touchscreen. Possibly, the switch changes the elevator installation to the specific operating mode when the first input area on the touchscreen is touched; the switch outputs at least one acknowledgement signal, when the first input area on the touchscreen is touched for a long time; the switch selects at least one input signal or passenger information item, which is correlated with the most recently output acknowledgement signal, when the touching of the first input area on the touchscreen for a long time ends. In some cases, the switch changes the elevator installation to the specific operating mode when the first input area on the touchscreen is touched; the switch outputs at least one predefined sequence of acknowledgement signals when the first input area on the touchscreen is touched for a long time; and in that the switch selects the input signal and/or the passenger information item when the touching of the first input area on the touchscreen for a long time ends, which input signal or passenger information item is correlated with the most recently output acknowledgment signal in the sequence of acknowledgment signals.

This can mean that the passenger can easily and intuitively use the switch to report his disability to the call input device.

In further cases, the switch changes the elevator installation to the specific operating mode when the first input area on the touchscreen is touched; the switch outputs at least one acknowledgement signal for a call or destination call when the first input area on the touchscreen is touched for a long time; and the switch selects at least one input signal or passenger information item, which is correlated with the most recently output acknowledgment signal, for a call or destination call when the touching of the first input area on the touchscreen for a long time ends. Possibly, one of a plurality of further functional designators is selected depending on the time duration of touching at least one further input area on the touchscreen. Possibly, at least one acknowledgment signal is output when the further input area on the touchscreen is touched for a long time; at least one input signal or passenger information item, which is correlated with the most recently output acknowledgment signal, is selected when the touching of the further input area on the touchscreen for a long time ends.

This can mean that the passenger can easily and intuitively enter travel requests on the call input device.

Further embodiments relate to a method for retrofitting an elevator installation with a call input device having at least one touchscreen for inputting at least one call for an elevator installation, wherein at least one switch is attached in a force-fitting, interlocking and/or integral manner to the call input device, such that the switch projects from at least one area of the call input device, outside the touchscreen, into at least one first input area on the touchscreen. The invention relates to a method for retrofitting an elevator installation with a call input device having at least one touchscreen for inputting at least one call for an elevator installation, wherein at least one switch is attached in an interlocking and force-fitting manner to at least one edge of a housing of the call input device, such that the switch projects from at least one area of the call input device, outside the touchscreen, into at least one first input area on the touchscreen. The invention relates to a method for retrofitting an elevator installation with a call input device having at least one touchscreen for inputting at least one call for an elevator installation, wherein at least one switch is inserted into at least one groove in the call input device and is thus attached in an interlocking and force-fitting manner, such that the switch projects from at least one area of the call input device, outside the touchscreen, into at least one first input area on the touchscreen.

This can mean that an existing elevator installation can be easily and quickly retrofitted with a call input device having at least one touchscreen, to form an elevator installation which complies with EN81-70.

In some embodiments, a computer program product comprises at least one computer program means which is suitable for implementing the method for operation of an elevator installation, in that at least one method step is carried out when the computer program means is loaded in at least one processor of at least one call input device or at least one destination call controller, at least one elevator controller or at least one programming station. Possibly, the computer-legible data memory comprises a computer program product such as this.

BRIEF DESCRIPTION OF THE DRAWINGS

Exemplary embodiments of the disclosed technologies will be explained in detail with reference to the figures, in which, in some cases schematically.

DETAILED DESCRIPTION

Figure 1:
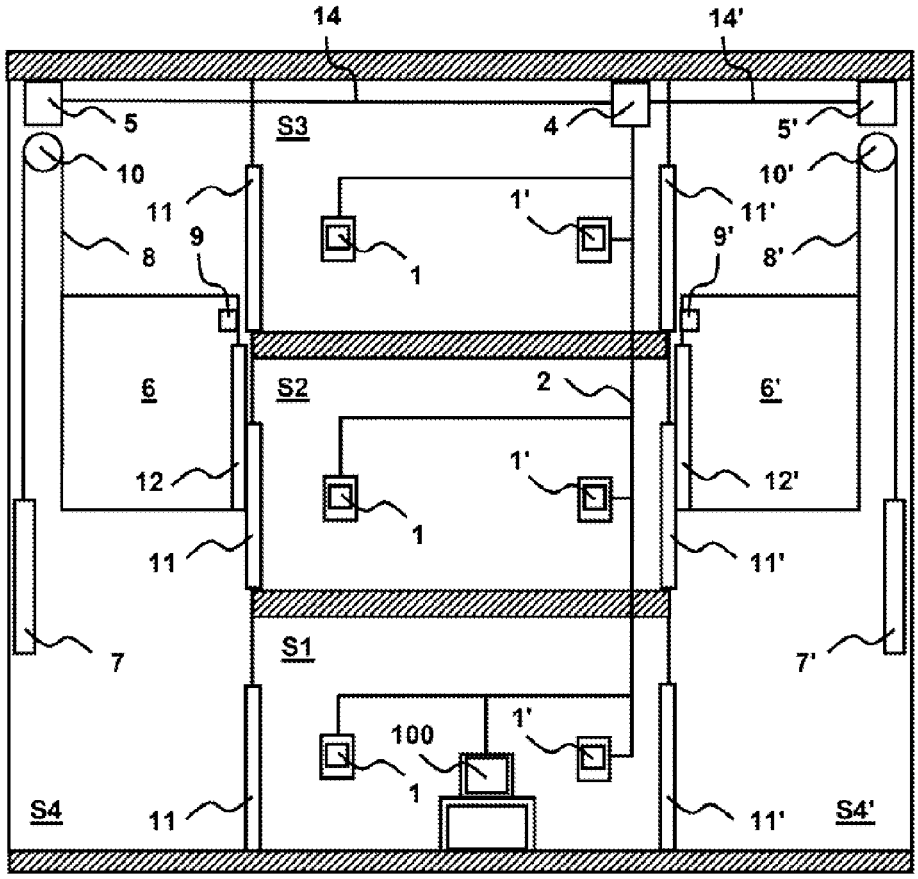
FIG. 1 shows a first exemplary embodiment of an elevator installation having a call input device as shown in one of FIGS. 3 to 10.
Figure 2:
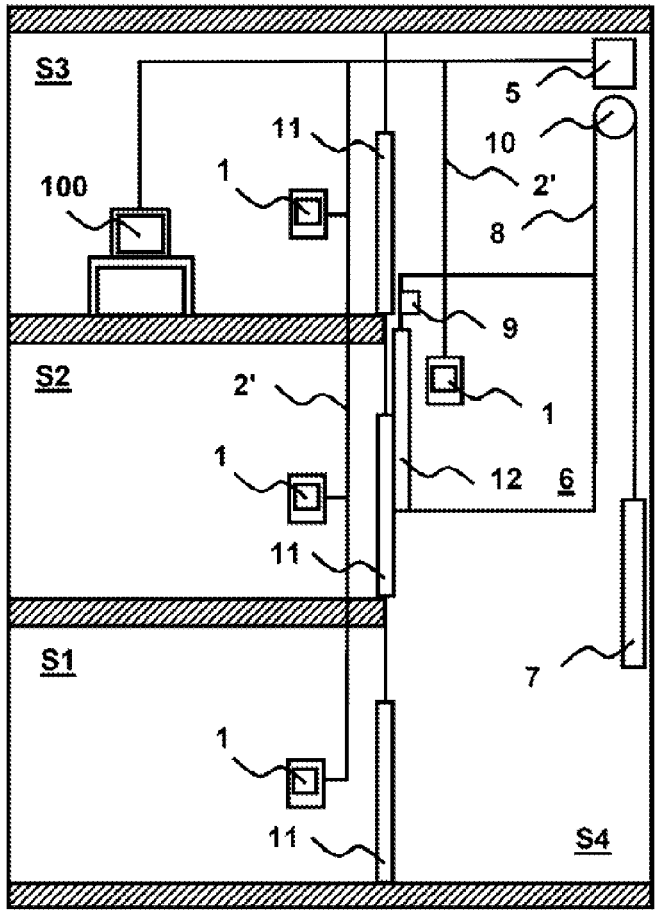
FIG. 2 shows a second exemplary embodiment of an elevator installation having a call input device as shown in one of FIGS. 3 to 10.

FIGS. 1 and 2 show two exemplary embodiments of an elevator installation in a building. The building has a relatively large number of floors S1 to S3, which are served by at least one elevator car 6, 6'. A passenger can enter and leave the elevator car 6, 6' on each floor S1 to S3 via at least one elevator door 11, 11', 12, 12'. In at least one elevator shaft S4, S4', the elevator car 6, 6' is connected to at least one counterweight 7, 7' via at least one supporting means 8, 8'. In order to move the elevator car 6, 6' and the counterweight 7, 7', the supporting means 8, 8' is set in motion by a friction drive by at least one elevator drive 10, 10'. Normally, at least one door drive 9, 9' is arranged on the elevator car 6, 6', and operates the elevator door 11, 11', 12, 12'. In the case of the elevator door 11, 11', 12, 12', a distinction is drawn between a floor door 11, 11', which is arranged on each floor S1 to S3, and a car door 12, 12' of the elevator car 6, 6'. While stopped at a floor, the car door 12, 12' can be operatively connected to the floor door 11, 11' by a mechanical coupling, such that the car door 12, 12' and the floor door 11, 11' are opened and closed at the same time. As shown in FIG. 1, two elevator cars 6, 6' are arranged in two elevator shafts S4, S4'. As shown in FIG. 2, an elevator car 6 is arranged in an elevator shaft S4. With knowledge of the present disclosure, a person skilled in the art can produce an elevator installation which serves more than three floors S1 to S3 and/or more than one elevator car 6, 6' per elevator shaft S4, S4', and/or a hydraulic drive and/or an elevator drive on the elevator car and/or on the counterweight and, of course, also an elevator installation without a counterweight.

At least one elevator controller 5, 5' has at least one processor and at least one computer-legible data memory. At least one computer program means is loaded from the computer-legible data memory into the processor, and is run. The computer program means operates the elevator drive 10, 10' and the door drive 9, 9'. At least one adapter for at least one Bus system 2' and/or at least one adapter for at least one signal line 14, 14', as well as at least one electrical power supply are arranged in at least one housing of the elevator controller 5, 5'. At least one call input device 1, 1' is arranged close to a floor door 11, 11' or in an elevator car 6. The call input device 1, 1' is mounted on a building wall in the floor door area and is positioned in an isolated form in the floor door area of the floors S1 to S3. At least one adapter for a Bus system 2, 2', at least one input/output appliance in the form of a touchscreen 13, at least one tone transmitter 15, at least one identification device 18 for identification of at least one identification code, and at least one electrical power supply are arranged in at least one housing of the call input device 1, 1'. The call input device 1, 1' has at least one processor and at least one computer-legible data memory. At least one computer program means is loaded from the computer-legible data memory into the processor, and is run. The computer program means operates the adapter and/or the touchscreen 13 and/or the tone transmitter 15 and/or the identification device 18. The identification device 18 is optional.

At least one destination call controller 4 has at least one processor, at least one computer-legible data memory, at least one adapter for a Bus system 2, and at least one electrical power supply. As shown in FIG. 1, the destination call controller 4 is an autonomous electronic unit in at least one housing of its own which, for example, is placed on the floor S3. The destination call controller 4 can also be an electronic withdrawable insert, for example in the form of a printed circuit board, which printed circuit board is arranged in the housing of a call input device 1, 1' or of an elevator controller 5, 5'.

The call input device 1, 1' and the destination call controller 4 and the elevator controller 5, 5' communicate bidirectionally via a Bus system 2, 2', such as a Universal Serial Bus (USB), Local Operating Network (LON), Modbus, Ethernet, etc. Communication takes place in the Bus system 2, 2' on the basis of a known protocol. As shown in FIG. 1, on each floor S1 to S3, two call input devices 1, 1' are connected for communication purposes to the destination call controller 4 via the Bus system 2. As shown in FIG. 2, on each floor S1 to S3, a call input device 1 is connected for communication purposes to an elevator controller 5 via a Bus system 2'. Each communication subscriber can be identified uniquely via an address of an adapter in the Bus system 2, 2'. The destination call controller 4 and the elevator controller 5, 5' communicate bidirectionally via a signal line 14, 14'. As shown in FIG. 1, the destination call controller 4 is connected for communication purposes to an elevator controller 5, 5' via a respective signal line 14, 14'. The communication subscribers can be identified uniquely at the ends of the permanently activated signal lines 14, 14'. With knowledge of the present disclosure, a person skilled in the art can combine the exemplary embodiments of an elevator installation as shown in FIGS. 1 and 2 with one another, for example such that a call input device 1, 1' is connected for communication purposes to a plurality of elevator controllers 5, 5' via a bus system 2', and/or such that a destination call controller 4 is connected for communication purposes to only one elevator controller 5, 5' via a signal line 14, 14'.

As shown in FIG. 1, the call input device 1, 1' in the Bus system 2 transmits a call, which is made by the passenger, as a destination call to the destination call controller 4. As shown in FIG. 2, the call input device 1 in the bus system 2' transmits a call, which is made by the passenger, as a floor call or as a car call to the elevator controller 5. In the case of a floor call, an elevator car 6 is first of all moved to the floor of the call input device 1. Once the passenger has entered the elevator car 6, a car call to a destination floor is made on a call input device 1 in the elevator car 6, and the elevator car 6 is moved to this destination floor. In the case of a destination call, a designation of a desired destination floor will have already been made during the call input, as a result of which there is no longer any need for a car call. The destination call controller 4 therefore already knows the destination floor when the call is input, and can therefore optimize not only the approach to the call input floor but also that to the destination floor.

The call input device 1, 1' uses the identification device 18 to identify an identification code of a passenger. To do this, the passenger holds at least one identification code bearer with the stored identification code against the identification device 18. The identification code bearer is, for example, a radio-frequency identification (RFID) card. The identification code is transmitted by radio to the identification device 18, and is identified by the identification device 18. The call input device 1, 1' or the destination call controller 4 allocates at least one passenger profile to an identified identification code. The passenger profile indicates at least one individual passenger information item for that passenger. The passenger information item is a predefined destination call, or a type of disability of the passenger, or a type of impediment of the passenger, or a type of safety or security hazard to the passenger, or a predefined communication language of the passenger, or a predefined elevator shaft S4, S4' or a predefined elevator car 6, 6'. The passenger information item based on the passenger profile is read by the call input device 1, 1' and/or by the destination call controller 4.

The destination call controller 4 determines at least one best call allocation for a destination call. The best call allocation denotes a movement by at least one elevator car 6, 6' from a starting floor to a destination floor with the shortest possible waiting time and/or the shortest possible time to the destination. The starting floor need not match the call input floor. In addition, the destination floor need not match the destination floor desired by the passenger on the basis of the destination call. When assigning the best call allocation to the elevator car 6, 6', at least one start call signal and at least one destination call signal are produced, and are transmitted via the signal line 14, 14' to the adapter for the elevator controller 5, 5' for this elevator car 6, 6'.

The touchscreen 13 is rectangular or has a circular symmetrical diameter. By way of example, the touchscreen 13 has a diameter of 5 cm and a thickness of 2 to 10 mm. The display is composed, for example, of glass or impact-resistant plastic, such as polyurethane, polypropylene, polyethylene etc. By way of example, a front face of the touchscreen 13 is composed of glass or impact-resistant plastic such as polyurethane, polypropylene, polyethylene. The front face of the touchscreen 13 can be seen by a passenger and can be touched directly by the passenger, for example using a finger. A plurality of functional principles of touchscreens 13 are known:

- In the case of a resistive touchscreen 13, when the touchscreen 13 is touched, an electrical contact is made between two previously electrically isolated electrically conductive layers. The electrical resistance of this electrical contact can be detected by at least one sensor as an input signal, with two-dimensional position resolution via a position coordinate.
- In the case of a capacitive touchscreen 13, an electrical field applied to the display is changed when the touchscreen is touched. This electrical field change can also be detected by at least one sensor as an input signal with two-dimensional position resolution via a position coordinate.
- In the case of an optical touchscreen 13, a light beam is interrupted when the touchscreen 13 is touched. The position of the light-beam interruption can be detected by at least one sensor as an input signal with two-dimensional position resolution via a position coordinate.
- In the case of a surface wave touchscreen 13, horizontal and vertical ultrasound waves are reflected when the touchscreen 13 is touched. This ultrasound wave reflection can also be detected by at least one sensor as an input signal with two-dimensional position resolution via a position coordinate.

Figure 4:
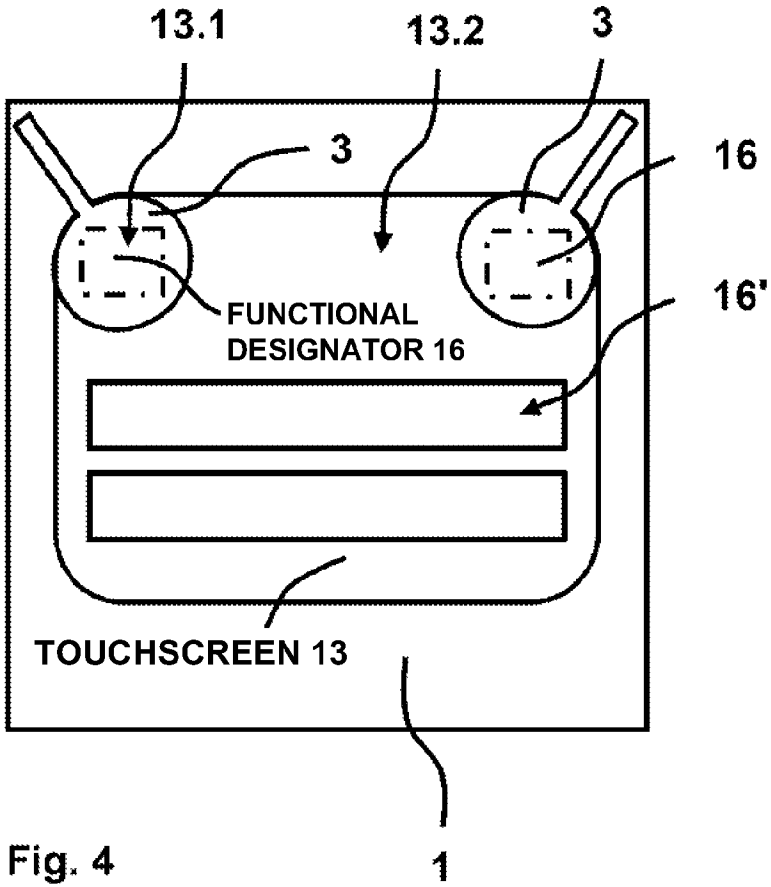
FIG. 4 shows a view of a part of a second exemplary embodiment of a call input device having a functional designator.
Figure 3:
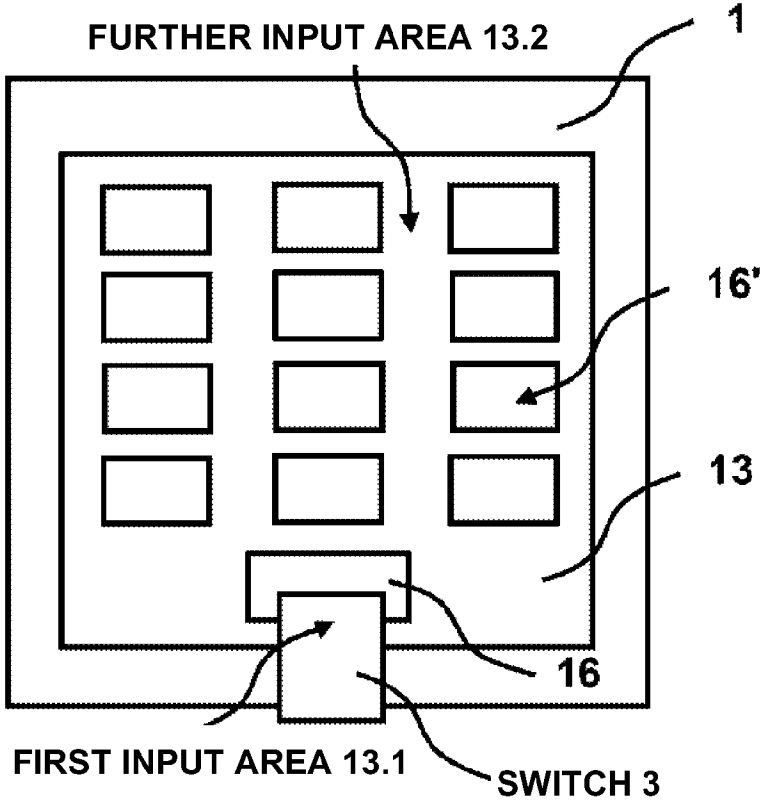
FIG. 3 shows a view of a part of a first exemplary embodiment of a call input device having a functional designator.

That surface of the touchscreen 13 which can be seen by the passenger has at least one functional designator 16, 16'. The functional designators 16, 16' are pictograms or alphanumeric character sequences. The functional designators 16, 16' are produced by at least one light-emitting element such as a liquid crystal display (LCD), light emitting display (LED) or organic light emitting display (OLED), etc. Each light-emitting element can be operated by the computer program means, and the number, size, color and shape of the functional designators 16, 16' are freely programmable. As shown in FIG. 3, a first functional designator 16 is arranged on a lower edge area of the touchscreen 13, and twelve further functional designators 16' are arranged above this, in a central area of the touchscreen 13. As shown in FIG. 4, a first functional designator 16 is arranged on a corner area of the touchscreen 13, and two further functional designators 16' are arranged in a central area of the touchscreen 13. The further functional designators 16' are, for example, digits "0" to "9" for floor input as well as a "bell symbol" for an alarm, and/or a position designator such as "lobby", "library", etc., and/or name designators such as "Schmidt family", "Meier Company", etc. A first input signal is produced when the first functional designator 16 is touched. The call input device 1, 1' transmits the first input signal to the destination call controller 4 and/or the elevator controller 5, 5'. The destination call controller 4 or the elevator controller 5, 5' changes the elevator installation to at least one specific operating mode for a received further input signal. A further input signal is produced by touching a further functional designator 16'. The call input device 1, 1' transmits the further input signal to the destination call controller 4 and/or the elevator controller 5, 5'. The destination call controller 4 or the elevator controller 5, 5' makes at least one call for the transmitted further input signal. By way of example, the elevator installation is changed to a specific operating mode by touching the first functional designator 16 for a predetermined time period of five seconds to twenty seconds. Touching the first functional designator 16 and touching the further functional designator 16' on one and the same call input device 1, 1' changes the elevator installation to a specific operating mode until the call made by touching the further functional designator 16' has been carried out completely. A floor call is completed when the passenger has entered an elevator car 6, 6' at the starting floor; a car call or destination call is completed when the elevator door 11, 11', 12, 12' has been completely opened at the destination floor. Therefore, when a first functional designator 16 is touched, followed by a further functional designator 16' being touched on one and the same call input device 1, 1' during the specific operating mode, the call made in this way is handled using the specific operating mode.

In the specific operating mode, a passenger is transported by the elevator installation in the building without necessarily being affected by a disadvantage. The disadvantage may be a disability of the passenger or a potential safety or security hazard to the passenger. In the simplest case, the first input signal indicates in binary form whether the passenger is or is not disabled and/or whether the passenger is or is not subject to a safety or security hazard.

The first input signal can indicate in detail the nature of the disability, such as a physical disability, blindness, deafness, etc. The disability may be a physical disability or a mental disability. For example, it may be possible for the passenger to move or be oriented in the building only using at least one disabled-specific aid. By way of example, a disabled-specific aid is a wheelchair, a hospital bed on rollers, a crutch, a hearing aid, a vision aid, a blind person's stick, a guide dog for the blind, etc. It is also possible for a severely disabled passenger to be able to move only with the aid of at least one accompanying passenger. For example, an accompanying passenger pushing the wheelchair of the severely disabled passenger makes a call input for the severely disabled passenger.

It is also possible for the first input signal to indicate whether the passenger with the disability requires passive personal protection or active personal protection. For example, it may be possible for the passenger to move in the building only using at least one personal-protection-specific aid. By way of example, a personal-protection-specific aid is a three-dimensional protection zone or a time protection zone, or a personal protector. For example, a three-dimensional protection zone or a time protection zone with as few other passengers in the elevator car 6, 6' as possible is produced for the passenger with a disability. To this end, other passengers may be transported by the elevator car 6, 6' at earlier or later times. It is also possible for a passenger who is subject to an acute safety or security hazard to be accompanied by at least one personal protector in the elevator car 6, 6'.

In the specific operating mode, the call input device 1, 1' and/or the elevator door 11, 11', 12, 12' and/or the elevator car 6, 6' is or are accordingly operated as follows:

For a passenger having a disabled-specific aid, the elevator door 11, 11', 12, 12' is closed with a particularly long delay, and it is closed particularly slowly. While, in the normal operating mode, an elevator door 11, 11', 12, 12' is closed after a delay of two to twenty seconds and the elevator door 11, 11', 12, 12' requires around two seconds for the closing process, the delay and the closing process for a passenger with a disabled-specific aid are 10% to 50% more.

For a passenger with a disability-specific aid, the elevator car 6, 6' is stopped with particular accuracy at the floor S1 to S3. While, in the normal operating mode, the height difference between a floor of the elevator car 6, 6' and a threshold of the floor door 11, 11' may be more than 10 mm, a maximum height difference between the floor of the elevator car 6, 6' and the threshold of the floor door 11, 11' of +/−10 mm is stipulated in accordance with EN81-70 for a passenger with a disabled-specific aid.

A passenger with a disabled-specific aid or a personal-protection-specific aid is assigned a particularly large amount of space in an elevator car 6, 6'. While, in the normal operating mode, an elevator car 6, 6' with a payload of 450 kg can accommodate up to six passengers, this elevator car 6, 6' with a payload of 450 kg is assigned a single passenger with a disabled-specific aid or a personal-protection-specific aid. Analogously, an elevator car 6, 6' with a payload of 630 kg, which can accommodate up to eight passengers in the normal operating mode, is assigned one passenger with a disabled-specific aid as well as an accompanying passenger, and/or a safety or security-endangered passenger as well as a personal protector.

A passenger with a personal-protection-specific aid is transported by the elevator car 6, 6' directly from the call input floor to the destination floor. While, in the normal operating mode, the elevator car 6, 6' makes one or more intermediate stops or changeover stops, a passenger with a personal-protection-specific aid is transported from the call input floor to the desired destination floor without any intermediate stops or changeover stops.

At least one switch 3 is fitted to the call input device 1, 1' in order to change the elevator installation to a specific operating mode in compliance with EN81-70. As shown in FIGS. 3, 5, 6 and 9, a switch 3 is fitted in a lower area 1.1 of the call input device 1, 1', outside the touchscreen 13, and projects from this area 1.1 of the call input device 1, 1' into a first input area 13.1 on the touchscreen 13. Such placing of the switch 3 in a lower area 1.1 of the call input device 1, 1' makes it possible to comply with the maximum height of the switch 3, as specified in EN81-70, of 1100 mm or 1200 mm above the floor level of the floor 51 to S3 and the elevator car 6, 6'. As shown in FIGS. 4, 7, 9 and 10, a first and a second switch 3 are fitted in a left-hand and a right-hand area 1.1 of the call input device 1, 1', outside the touchscreen 13, and project from these areas 1.1 of the call input device 1, 1' into a first input area 13.1 on the touchscreen 13. Further input areas 13.2 on the touchscreen 13 do not have any switch 3 projecting over them.

The switch 3 is rectangular or has a circular symmetrical diameter. By way of example, the switch 3 has a diameter of 10 mm to 20 mm and a thickness of 2 mm to 10 mm. By way of example, the switch 3 is composed of plastic material such as polyurethane, polypropylene, polyethylene etc., or metal material such as aluminum, sheet steel, etc., or alloy material such as brass, bronze etc. A front face of the switch 3 can be seen by a passenger, and can be touched directly by the passenger, for example using a finger. By way of example, the front face of the switch 3 is identifiable in accordance with EN81-70 by a wheelchair user pictogram as a pushbutton for the disabled, and/or the front face of the switch 3 is identifiable in accordance with EN81-70 by Braille script characters with a height of at least 0.8 mm as a pushbutton for the disabled, and is identifiable by blind passengers.

As illustrated in detail in FIGS. 5 to 8, the switch 3 in the first input area 13.1 on the touchscreen 13 can be moved from a first, non-switching position, to a second, switching position by a pressure force F of 2.50N to 5.0N. While the switch 3 does not touch the touchscreen 13 in the first, non-switching position, the switch 3 touches a first functional designator 16 on the touchscreen 13 in the second, switching position. Because of elastic prestressing of the material of the switch 3, it is automatically moved back again from the second, switching position, to the first, non-switching position in the absence of a pressure force F. By way of example, the switch 3 is designed such that, when moved from the first, non-switching position, to the second, switching position, and when moved from the second, switching position, to the first, non-switching position, it produces audible feedback between 35 dB and 65 dB, which can be heard well by the passenger with a disability. The automatic return movement of the switch 3 to the first, non-switching position takes place within five seconds, preferably two seconds.

Figure 5:
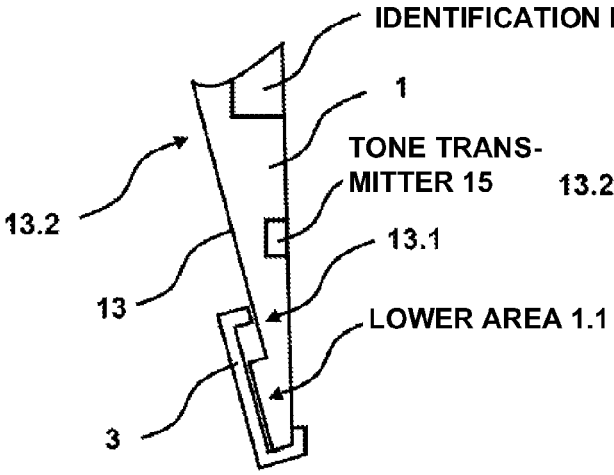
FIG. 5 shows an enlarged side view of the first exemplary embodiment of a call input device as shown in FIG. 3, before operation of the switch.
Figure 6:
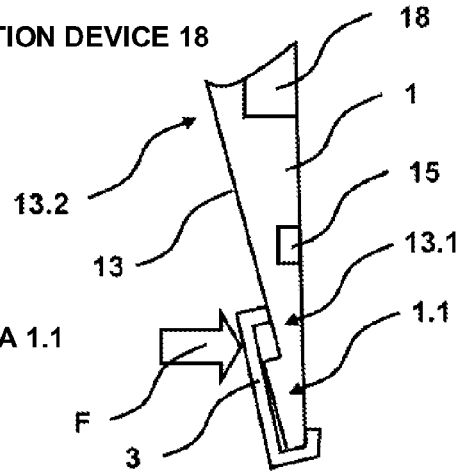
FIG. 6 shows an enlarged side view of the first exemplary embodiment of a call input device as shown in FIGS. 3 and 5, after operation of the switch.
Figure 7:
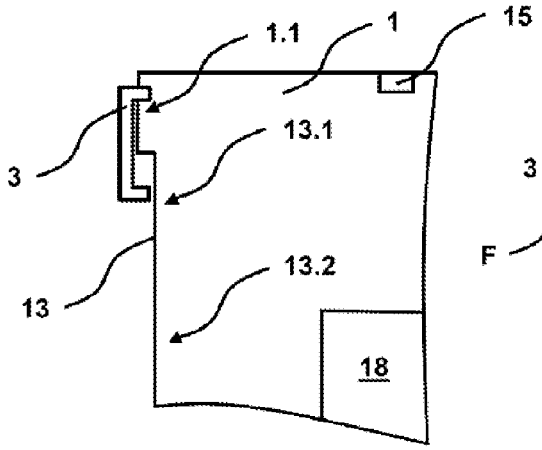
FIG. 7 shows an enlarged side view of the second exemplary embodiment of a call input device as shown in FIG. 4, before operation of the switch.
Figure 8:
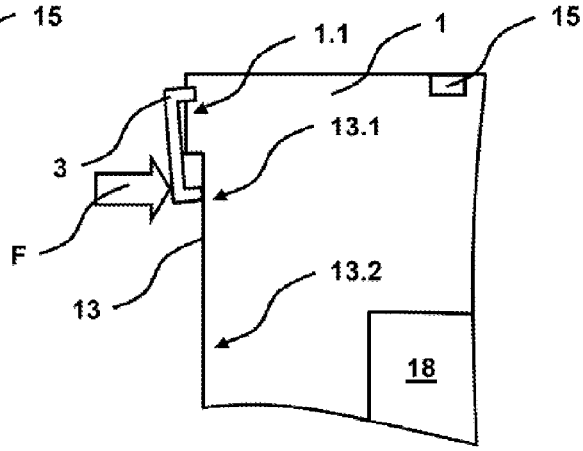
FIG. 8 shows an enlarged side view of the second exemplary embodiment of a call input device as shown in FIGS. 4 and 7, after operation of the switch.

The switch 3 is attached to the call input device 1, 1' in a force-fitting and/or interlocking and/or integral manner. As shown in FIGS. 3, 5 and 6, the switch 3 projects around at least one end of the call input device 1, 1' and is attached in an interlocking and force-fitting manner to at least one edge of a housing of the call input device 1, 1'. As shown in FIGS. 4, 7 and 8, the switch 3 is inserted into at least one groove in the call input device 1, 1', and is thus attached in an interlocking and force-fitting manner. The switch 3 can be reversibly or irreversibly attached. If attached reversibly, the switch 3 can be removed from the call input device 1, 1' again without destroying it, and if attached irreversibly, the switch 3 can be removed from the call input device 1, 1' again only by at least partially destroying it.

Figure 9:
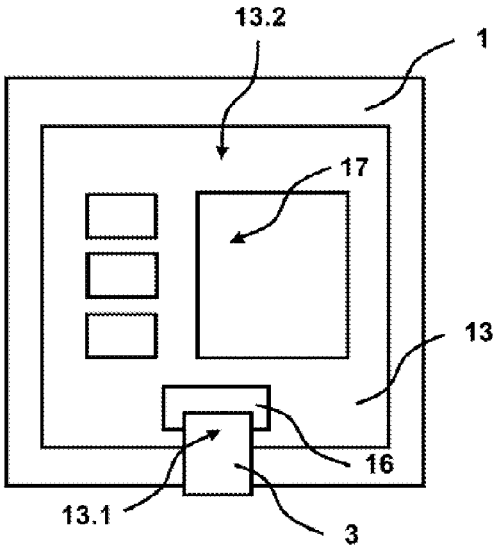
FIG. 9 shows a view of a part of the first exemplary embodiment of a call input device as shown in FIGS. 3, 5 and 6 with an acknowledgement signal.
Figure 10:
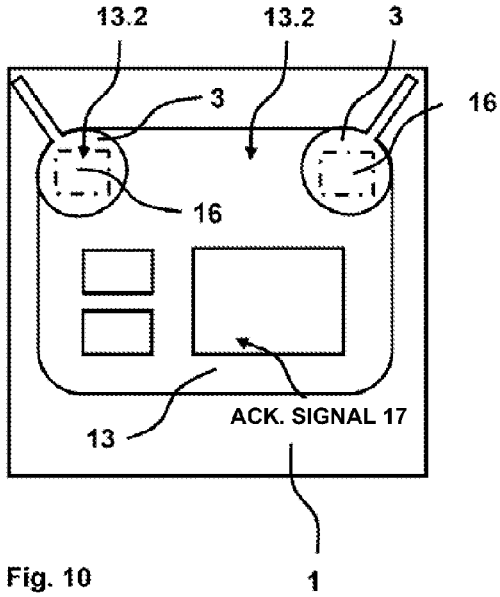
FIG. 10 shows a view of a part of the second exemplary embodiment of a call input device as shown in FIGS. 4, 7 and 8 with an acknowledgement signal.

Every input signal and every read passenger information item are confirmed visually and/or audibly by at least one acknowledgement signal 17 on the touchscreen 13 and/or by the tone transmitter 15. The passenger therefore receives a visual or audible acknowledgement that a functional designator 16, 16' on the touchscreen 13 has been touched. The acknowledgement signal 17 on the touchscreen 13 is a pictogram and/or alphanumeric character sequences, and is produced by at least one light-emitting element, such as a liquid crystal display (LCD), light emitting display (LED) or organic light emitting display (OLED), etc. Each light-emitting element can be operated by the computer program means, and the number, size, color and shape of the acknowledgment signal 17 on the touchscreen 13 is freely programmable. As shown in FIGS. 9 and 10, a plurality of acknowledgement signals 17 are arranged in a central area of the touchscreen 13. The acknowledgment signal 17 produced by the tone transmitter 15 is, for example, a tone sequence, melody, or a synthetic voice output. Each acknowledgement signal 17 uniquely acknowledges an input signal correlated with a functional designator 16, 16'. With knowledge of the present disclosure, the acknowledgement signal can, of course, also be output on a different elevator installation output device, which is physically separated from the call input device 1, 1'. A different output device such as this is, for example, a car status indication above the floor door 11, 11', or a floor indication within the elevator car 6, 6'. A plurality of acknowledgement signals 17 can be output on the touchscreen 13 or tone transmitter 15:

- Confirmation of the change of the elevator installation to the specific operating mode. A wheelchair user pictogram is output on the touchscreen 13, and the tone transmitter 15 outputs a tone at, for example, 600 Hz to the passenger, as an acknowledgement signal 17. While, for example in the normal operating mode, alphanumeric character sequences may also have a height of less than 15 mm, they are at least 15 mm high, and preferably at least 18 mm high, in the specific operating mode.
- Confirmation of the change of the elevator installation to the normal operating mode. A passenger pictogram is output on the touchscreen 13, and the tone transmitter 15 outputs a tone at, for example, 400 Hz to the passenger, as an acknowledgment signal 17.
- Confirmation of the call input by the passenger. An "OK" is output on the touchscreen 13, and the tone transmitter 15 outputs a tone at, for example, 500 Hz to the passenger, as an acknowledgement signal 17.
- Request for the communication language desired by the passenger. A plurality of national flags, such as that of the United Kingdom for English, that of the USA for US-American, that of Germany for German, that of France for French, that of China for Chinese, etc., are output on the touchscreen 13, as an acknowledgement signal 17. At the same time, the tone transmitter 15 produces an appropriate synthetic voice output in the respective language.
- Request for the nature of the disability of the passenger. A plurality of possible types of passenger disabilities are output on the touchscreen 13, as an acknowledgement signal 17. For example, this requests whether the passenger can move and/or can be oriented in the building only using at least one disabled-specific aid, and/or whether the passenger can move in the building only using at least one personal-protection-specific aid. At the same time, the tone transmitter 15 produces an appropriate synthetic voice output.
- Provision of at least one aid. At least one assistance text is output on the touchscreen 13, and/or the tone transmitter 15 outputs at least one synthetic assistance text, as an acknowledgement signal 17.
- Confirmation that passenger information has been read from a passenger profile. The call input device 1, 1' or the destination call controller 4 reads predefined passenger information from a passenger profile for an identified transmitted identification code. At least one appropriate text is output on the touchscreen 13, as an acknowledgement signal 17, and/or the tone transmitter 15 outputs at least one appropriate synthetic text, as an acknowledgment signal 17.
- Designation of the direction of travel desired by the passenger. An arrow pointing "upward" or "downward" is output on the touchscreen 13 to the passenger, as an acknowledgement signal 17. The arrow or the background of the arrow can blink. For an "upward" direction of travel, the tone transmitter 15 outputs a high tone of, for example, 550 Hz to the passenger, while for a "downward" direction of travel, the tone transmitter 15 outputs a low tone of, for example, 450 Hz to the passenger.
- Designation of the destination floor desired by the passenger. For a destination floor which is desired by the passenger and which destination floor corresponds to the floor S3, a "3" is output on the touchscreen 13, and the tone transmitter 15 outputs a tone sequence of, for example, three tones at 490 Hz, 500 Hz and 510 Hz, to the passenger as an acknowledgement signal 17.
- Designation of the elevator shaft S4, S4', from which a call is being made. The elevator shaft S4, S4' of the elevator car 6, 6' which is handling the call from the passenger is output on the touchscreen 13 in the form of a letter "B" and the tone transmitter 15 outputs a tone at 400 Hz, as an acknowledgment signal 17. The letter "B" and/or the background can blink.
- Designation of the elevator car 6, 6', which will handle the call. When there are a plurality of elevator cars 6, 6' in one elevator shaft S4, S4', for example an upper and a lower elevator car 6, 6' of a double-decker elevator, then the elevator car 6, 6' which is handling the call from the passenger is output on the touchscreen 13 in the form of a number "2" and by a melody, as an acknowledgment signal 17. The number "2" and/or the background can blink. This communicates to the passenger that he should enter the second elevator car 6, 6'.
- Output of the start and the duration of the opening/closing of the elevator door 11, 11', 12, 12'. The passenger is warned of the start and the duration of the opening/closing of the elevator door 11, 11', 12, 12' by blinking of the touchscreen 13 and by the tone transmitter 15 outputting a tone at 500 Hz in time with the blinking
- Output of the arrival time of the elevator car 6, 6' at the starting floor and/or destination floor. An arrival time of the elevator car 6, 6' is indicated in digital form on the touchscreen 13, for example as a numerical sequence "14s", "13s", etc., counting backwards. At the same time, the tone transmitter 15 produces an appropriate synthetic voice output.

As shown in FIG. 1, at least one programming station 100 is placed on a floor S1 adjacent to the entrance to the building, close to a reception area or building administration or, as shown in FIG. 2, on a floor S3 of a passenger's apartment. The programming station 100 may also be a mobile computer, such as a smart phone, a mobile telephone, etc. The programming station 100 has at least one processor, at least one computer-legible data memory, at least one adapter for the Bus system 2, 2' and at least one electrical power supply. At least one computer program means can be loaded from the computer-legible data memory into the processor. The computer program means which has been loaded into the processor controls the creation of the input/output information. The input/output information comprises the functional designators 16, 16', the acknowledgment signal 17, a sequence of acknowledgment signals 17 and/or a passenger profile. The computer program means transmits the input/output information via the Bus system 2, 2' to the call input device 1, 1' and/or to the destination call controller 4, where the transmitted input/output information can be stored in a computer-legible data memory. The input/output information stored in the call input device 1, 1' and/or in the destination call controller 4 can be read and can be used by the computer program means of the call input device 1, 1' and/or the destination call controller 4.

A first input area 13.1 on the touchscreen 13 may be a multipurpose area, such that the passenger can select the time duration of touching the first input area 13.1 on the touchscreen 13, in order to use the switch 3 to select one of a plurality of functional designators 16, 16' and/or a passenger information item according to the passenger profile. For example, when a first functional designator 16 is touched in a first input area 13.1, a first input signal is produced, and the elevator installation is changed to a specific operating mode. By way of example, the switch 3 is operated and, in a switching position in the first input area 13.1, touches a first functional designator 16, thus changing the elevator installation to a specific operating mode. If the first input area 13.1 is touched for a long time, at least one acknowledgment signal 17 is output on the touchscreen 13 and/or via the tone transmitter 15 when in the specific operating mode. In the specific operating mode, the switch 3 remains operated in the switching position, and a predefined sequence of acknowledgment signals 17 is automatically output:

A first acknowledgement signal 17 thus confirms that the elevator installation has been changed to the specific operating mode. A second acknowledgement signal 17 is correlated with the further input signal which corresponds to the statistically most frequent call input from this call input floor. A third acknowledgment signal 17 is correlated with the further input signal which corresponds to the statistically second most frequent call input from this call input floor. If the switch 3 is not operated back to the non-switching position when the third acknowledgement signal 17 is output, then the further input signal is selected, which corresponds to the statistically second most frequent call input from this call input floor.

A first acknowledgment signal 17 thus confirms that the elevator installation has been changed to the specific operating mode. If the passenger has transmitted an identification code to the call input device 1, 1', a second acknowledgment signal 17 is correlated with a predefined destination call based on the passenger profile. After the second acknowledgment signal 17 has been output, the switch 3 is operated back to the non-switching position, and the predefined destination call is selected based on the passenger profile.

A further input area 13.2 on the touchscreen 13 may also be a multipurpose area. The passenger can select one of a plurality of further functional designators 16' and/or a passenger information item based on the passenger profile by varying the time duration of touching at least one further input area 13.2 on the touchscreen 13. When touched for a long time, at least one acknowledgement signal 17 is output on the touchscreen 13 and/or via the tone transmitter 15. When the touching of the further input area 13.2 on the touchscreen 13 for a long time ends, at least one input signal is selected, which is correlated with the most recently output acknowledgement signal 17. If the passenger has transmitted an identification code to the call input device 1, 1', at least one passenger information item, which is correlated with the most recently output acknowledgment signal 17, based on the passenger profile is correlated when the touching of the further input area 13.2 on the touchscreen 13 for a long time ends.

By way of example, assistance is provided as an acknowledgement signal 17 as soon as a passenger places his entire hand on the touchscreen 13, and touches more than one further functional designator 16' at the same time. For example, a call is made to a destination floor desired by the passenger as an acknowledgment signal 17, which destination floor corresponds to the floor S3, as soon as the passenger uses a finger to touch the further functional designator 16' in the form of a "3". This call is confirmed to the passenger by an acknowledgment signal 17 in the form of a "3", and this is selected by the passenger by ceasing to touch the further input area 13.2 on the touchscreen 13.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

The invention claimed is:

1. An elevator call input device for an elevator installation, comprising:

a touchscreen, the touchscreen comprising an interior surface bounded by a perimeter; and a switch shaped and configured as an elevated button and extending from outside the perimeter of the touchscreen over a first input area in the interior surface of the touchscreen, wherein a touching of a predetermined portion of the switch to press against the first input area in the interior surface of the touch screen generates an input signal for the operation of the elevator installation.

2. The elevator call input device of claim 1, wherein the switch is removably attached to a surface of the call input device outside of the perimeter of the touchscreen.

3. The elevator call input device of claim 1, wherein the at least one switch comprises a wheelchair user pictogram.

4. The elevator call input device of claim 1, wherein the switch comprises one or more Braille characters.

5. The elevator call input device of claim 1, wherein the touching of the predetermined portion of the switch to press against the first input area changes the elevator installation to a specific operating mode for a predetermined time period.

6. The elevator call input device of claim 1, further comprising attachment means for attaching the switch to a surface outside of the perimeter of the touchscreen.

7. The elevator call input device of claim 1, wherein the switch is a first switch, the elevator call input device further comprising a second switch, the second switch extending from outside the perimeter of the touchscreen into a second input area in the interior surface of the touchscreen, wherein a touching of a predetermined portion of the second switch to press against the second input area generates a second input signal for the operation of the elevator installation.

8. The elevator call input device of claim 1, wherein the switch is configured to contact the touchscreen in a first position and further configured to not contact the touchscreen in a second position.

9. An elevator installation operation method, comprising:

receiving an input on a touchscreen of an elevator call input device, the touchscreen comprising an interior surface bounded by a perimeter, the input being provided through a contacting of a predetermined portion of a switch to a first input area in the interior surface of the touchscreen, the switch shaped and configured as an elevated button and extending from outside the perimeter of the touchscreen into the first input area; and based at least in part on the received input, placing the elevator installation in a disabled-passenger operating mode.

10. The elevator installation operation method of claim 9, further comprising:

receiving at least one destination input signal using the touchscreen while the elevator installation is in the disabled-passenger operating mode; and placing the elevator installation out of the disabled-passenger operating mode after acting on the at least one destination input signal.

11. The elevator installation operation method of claim 9, further comprising providing an acknowledgement signal to a passenger, the acknowledgement signal providing an indication that the elevator installation has been placed in the disabled-passenger operating mode.

12. The elevator installation operation method of claim 11, further comprising using the acknowledgment signal to determine whether the passenger has at least one disability.

13. The elevator installation operation method of claim 11, further comprising using the acknowledgment signal to determine at least one communication language used by the passenger.

14. The elevator installation operation method of claim 11, further comprising providing an elevator door opening duration to the passenger with the acknowledgement signal.

15. An elevator installation comprising:

an elevator call input device comprising at least one touchscreen, the elevator call input device further comprising at least one switch shaped and configured as an elevated button and extending from outside of the touchscreen over a first input area of the touch screen, wherein a touching of a predetermined portion of the switch to press against the first input area in the interior surface of the touch screen generates an input signal for the operation of the elevator installation.

16. One or more computer-readable storage media having encoded thereon instructions which, when executed by a processor, cause the processor to perform a method comprising:

receiving an input on a touchscreen of an elevator call input device, the touchscreen comprising an interior surface bounded by a perimeter, the input being provided through the contacting of a predetermined portion of a switch to a first input area in the interior surface of the touchscreen, the switch shaped and configured as an elevated button and extending from outside the perimeter of the touchscreen into the first input area; and based at least in part on the received input, placing the elevator installation in a disabled-passenger operating mode.

17. The one or more computer-readable storage media of claim 16, the method further comprising:

receiving at least one destination input signal using the touchscreen while the elevator installation is in the disabled-passenger operating mode; and placing the elevator installation out of the disabled-passenger operating mode after acting on the at least one destination input signal.

18. The one or more computer-readable storage media of claim 16, the method further comprising providing an acknowledgement signal to a passenger, the acknowledgement signal providing an indication that the elevator installation has been placed in the disabled-passenger operating mode.

* * * * *